US009938713B1

(12) United States Patent
Ertl

(10) Patent No.: US 9,938,713 B1
(45) Date of Patent: Apr. 10, 2018

(54) MECHANICALLY SECURED BLOCK BUILDING SYSTEM HAVING A PIPE OPENING THERETHROUGH

(71) Applicant: Dan Ertl, Anderson, IN (US)

(72) Inventor: Dan Ertl, Anderson, IN (US)

(73) Assignee: 3B Construction Solutions, Inc., Anderson, IN (US)

( * ) Notice: Subject to any disclaimer, the term of this patent is extended or adjusted under 35 U.S.C. 154(b) by 0 days.

(21) Appl. No.: 15/587,472

(22) Filed: May 5, 2017

(51) Int. Cl.
*E04B 2/44* (2006.01)
*E04C 1/39* (2006.01)
*E04B 2/02* (2006.01)

(52) U.S. Cl.
CPC ..... *E04B 2/44* (2013.01); *E04C 1/397* (2013.01); *E04B 2002/0254* (2013.01)

(58) Field of Classification Search
CPC ..... E04B 2/44; E04B 2002/0254; E04C 1/397
See application file for complete search history.

(56) References Cited

U.S. PATENT DOCUMENTS 2,703,487 A * 3/1955 Ossoinack ..... E04B 2/30 52/592.3
3,410,044 A * 11/1968 Moog ..... E04C 1/40 52/300
4,177,617 A * 12/1979 DeLuca ..... E04B 2/28 52/562
5,285,610 A * 2/1994 Schaaf ..... E04B 2/34 52/223.7
5,901,520 A * 5/1999 Abdul-Baki ..... E04B 2/16 52/421
7,934,345 B2 * 5/2011 Marsh ..... E02D 29/025 52/223.7
8,458,973 B1 * 6/2013 Powers, Jr. ..... E04C 3/20 249/19
9,091,055 B2 * 7/2015 Jensen ..... E04B 2/40
9,206,597 B2 * 12/2015 Marsh ..... E04B 2/16

FOREIGN PATENT DOCUMENTS

DE 4344852 A1 * 7/1994 ..... A01J 25/13
EP 1096076 A1 * 5/2001 ..... E04C 1/397

* cited by examiner

*Primary Examiner* — Jeanette E Chapman
(74) *Attorney, Agent, or Firm* — Kelly J. Smith; Brannon Sowers & Cracraft PC

(57) ABSTRACT

A set of building components of a mechanically secured block building system for constructing structures include a plurality of trough blocks. Each trough block has an interior cavity characterized by a U-shaped cross section and a pair of oppositely disposed inner ledges recessed relative to top surfaces of opposing outer walls. A bottom of each trough block includes a plurality of apertures therethrough. In an assembled configuration of the trough blocks, the trough blocks are mechanically secured in an end-to-end arrangement and the interior cavities align to define a continuous pipe channel therethrough.

5 Claims, 7 Drawing Sheets

MECHANICALLY SECURED BLOCK BUILDING SYSTEM HAVING A PIPE OPENING THERETHROUGH

TECHNICAL FIELD

The present disclosure relates generally to construction materials, and, more particularly, to a mechanically secured block building system accommodating the passage of pipes therethrough.

BACKGROUND

Existing unitized post tension systems address methods and systems to rapidly build structures, including walls with for use as flat deck, wider wall systems and large grade beams. Recent unitized post tension systems facilitated improvements to traditional construction systems and their limitations. These recently developed systems do not require special skills or tools to construct, do not require elaborate bracing, provide immediate occupancy, do not require water, mortar, and/or curing time, and are re-useable if desired since the constituent blocks are not destroyed when disassembled and moved. While the recent systems represent significant improvements over traditional building systems, such as a decrease in time to build or rebuild areas with minimal skilled labor and provide a far superior and more consistent strength structure than the traditional mortar constructed structure, these systems still have room for improvement. The present novel technology is directed to such improvements.

SUMMARY OF THE INVENTION

In one aspect, a set of building components of a mechanically secured block building system for constructing structures include a plurality of trough blocks. Each trough block has an interior cavity characterized by a U-shaped cross section and a pair of oppositely disposed inner ledges recessed relative to top surfaces of opposing outer walls. A bottom of each trough block includes a plurality of apertures therethrough. In an assembled configuration of the trough blocks, the trough blocks are mechanically secured in an end-to-end arrangement and the interior cavities align to define a continuous pipe channel therethrough.

In another aspect, a mechanically secured block building system for constructing structures includes a plurality of concrete masonry units. Each concrete masonry unit defines a length and a width and includes a plurality of through cavities extending from a top surface of the concrete masonry unit to a bottom surface of the concrete masonry unit. An anchor bar channel is formed in the top surface along the length of the concrete masonry unit. The system also includes a plurality of anchor bars with each anchor bar including an elongated body with first and second sets of apertures extending through the elongated body at opposing ends thereof. Each of the first and second sets of apertures are vertically aligned with one of the plurality of through cavities of the concrete masonry units when the anchor bar is positioned within the anchor bar channel. The system also includes a plurality of trough blocks. Each trough block has dimensions corresponding to each concrete masonry unit and has an interior cavity characterized by a U-shaped cross section. Each trough block also has a pair of oppositely disposed inner ledges recessed relative to top surfaces of opposing outer walls. A bottom of the trough blocks includes a plurality of apertures therethrough. The system further includes a plurality of cross bar pairs, with each cross bar pair including first and second cross bars, and each of the first and second cross bars including non-threaded apertures through opposing ends thereof and a centrally positioned set of apertures. The non-threaded apertures on opposing ends of the first and second cross bars are vertically aligned with the apertures through the bottom of the trough block when outer ends of the first and second cross bars are supported on the oppositely disposed inner ledges of the trough block. In an assembled configuration of the trough blocks, the trough blocks are mechanically secured in an end-to-end arrangement and the interior cavities align to define a continuous pipe channel therethrough.

In yet another aspect, a method of constructing a structure using the mechanically secured block building system described above is provided. The method includes a step of supporting outer ends of first and second cross bars of a first cross bar pair on the oppositely disposed inner ledges of a first trough block. Each of the first and second cross bars includes non-threaded apertures through opposing ends thereof and a centrally positioned set of apertures. The method also includes steps of positioning a first concrete masonry unit above the first trough block in a stacked configuration, and supporting a first anchor bar within the anchor bar channel of the first concrete masonry unit. The first anchor bar includes an elongated body with first and second sets of apertures extending through the elongated body at opposing ends thereof. The method also includes steps of passing a first bolt through a non-threaded aperture of the first set of apertures of the first anchor bar, a first through cavity of the first concrete masonry unit, and threading the first bolt into a threaded aperture of the centrally positioned set of apertures of the first cross bar, and passing a second bolt through a non-threaded aperture of the second set of apertures of the first anchor bar, a second through cavity of the first concrete masonry unit, and threading the second bolt into a threaded aperture of the centrally positioned set of apertures of the second cross bar.

DETAILED DESCRIPTION

Figure 1:
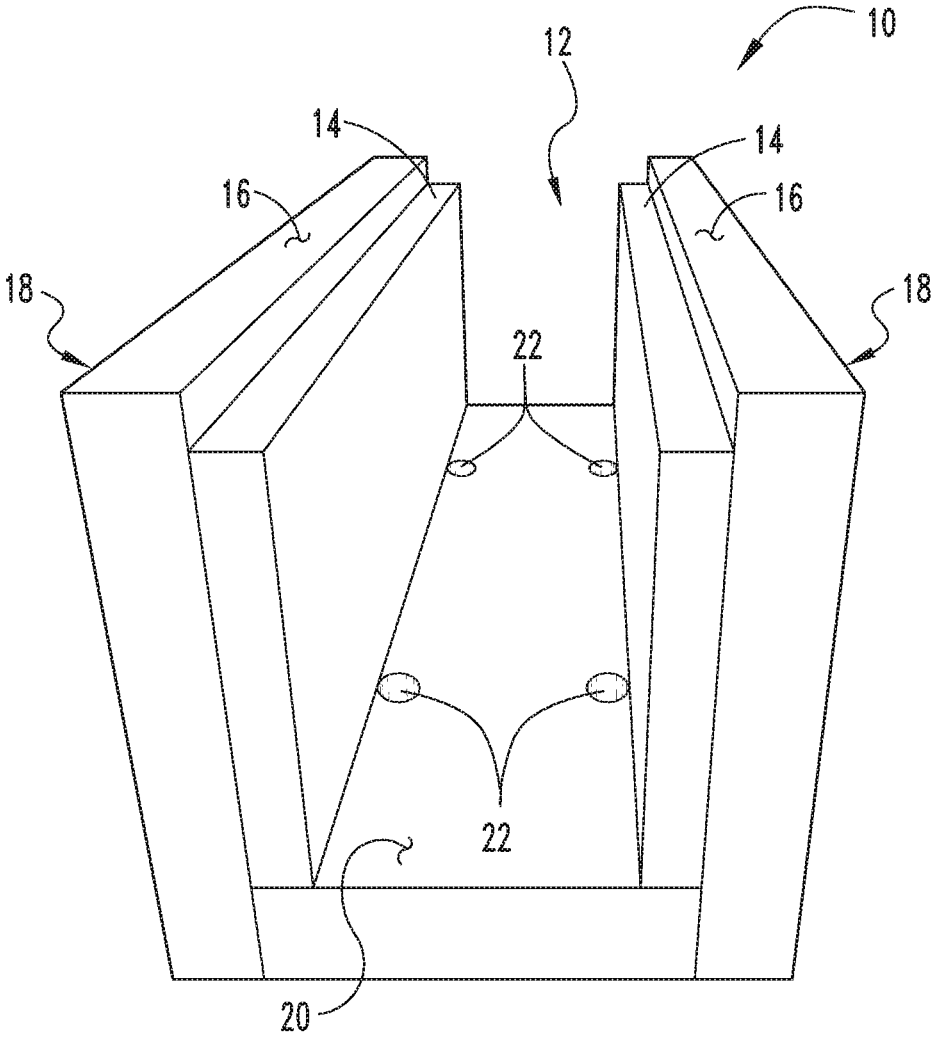
FIG. 1 is a perspective view of an exemplary trough block, according to the present disclosure.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

An exemplary building component of a mechanically secured block building system for constructing structures, according to the present disclosure, is shown in FIG. 1. The mechanically secured block building system, which will be described herein, includes a plurality of trough blocks, similar to a trough block shown at 10 in FIG. 1. Each trough block 10 has an interior cavity 12 characterized by a U-shaped cross section and a pair of oppositely disposed inner ledges 14 recessed relative to top surfaces 16 of opposing outer walls 18. A bottom 20 of each trough block 10 includes a plurality of apertures 22 therethrough.

Figure 2:
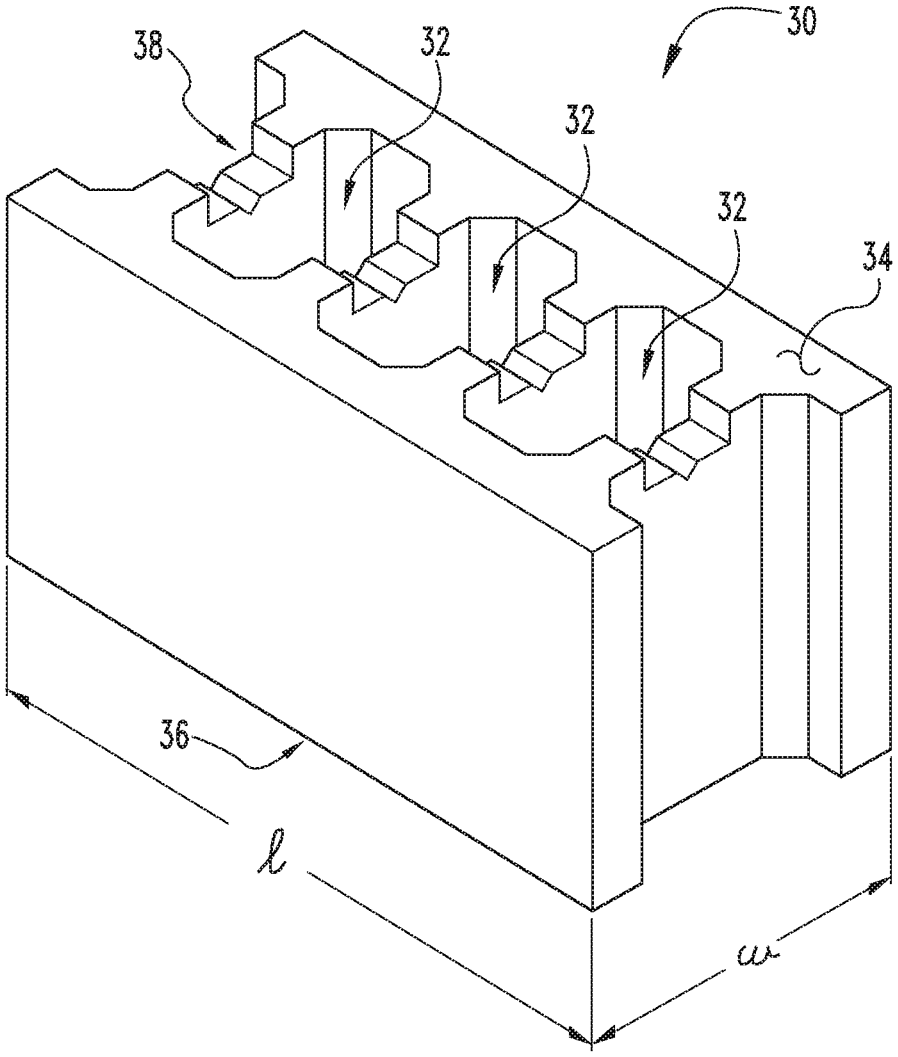
FIG. 2 is a perspective view of an exemplary concrete masonry block, according to the present disclosure.

The mechanically secured block building system of the present disclosure also includes a plurality of concrete masonry units 30, similar to a concrete masonry unit 30 of FIG. 2. Each concrete masonry unit 30, which may be similar to a conventional concrete masonry unit or concrete block, defines a length l and a width w and includes a plurality of through cavities 32 extending from a top surface 34 of the concrete masonry unit 30 to a bottom surface 36 of the concrete masonry unit 30. An anchor bar channel 38 is formed in the top surface 34 along the length l of the concrete masonry unit 30, and, according to some embodiments, the anchor bar channel 38 may be centered relative to the width w of each concrete masonry unit 30 and may pass through the cavities 32. The trough blocks 10 and concrete masonry units 30 may have corresponding dimensions and materials.

Figure 3:
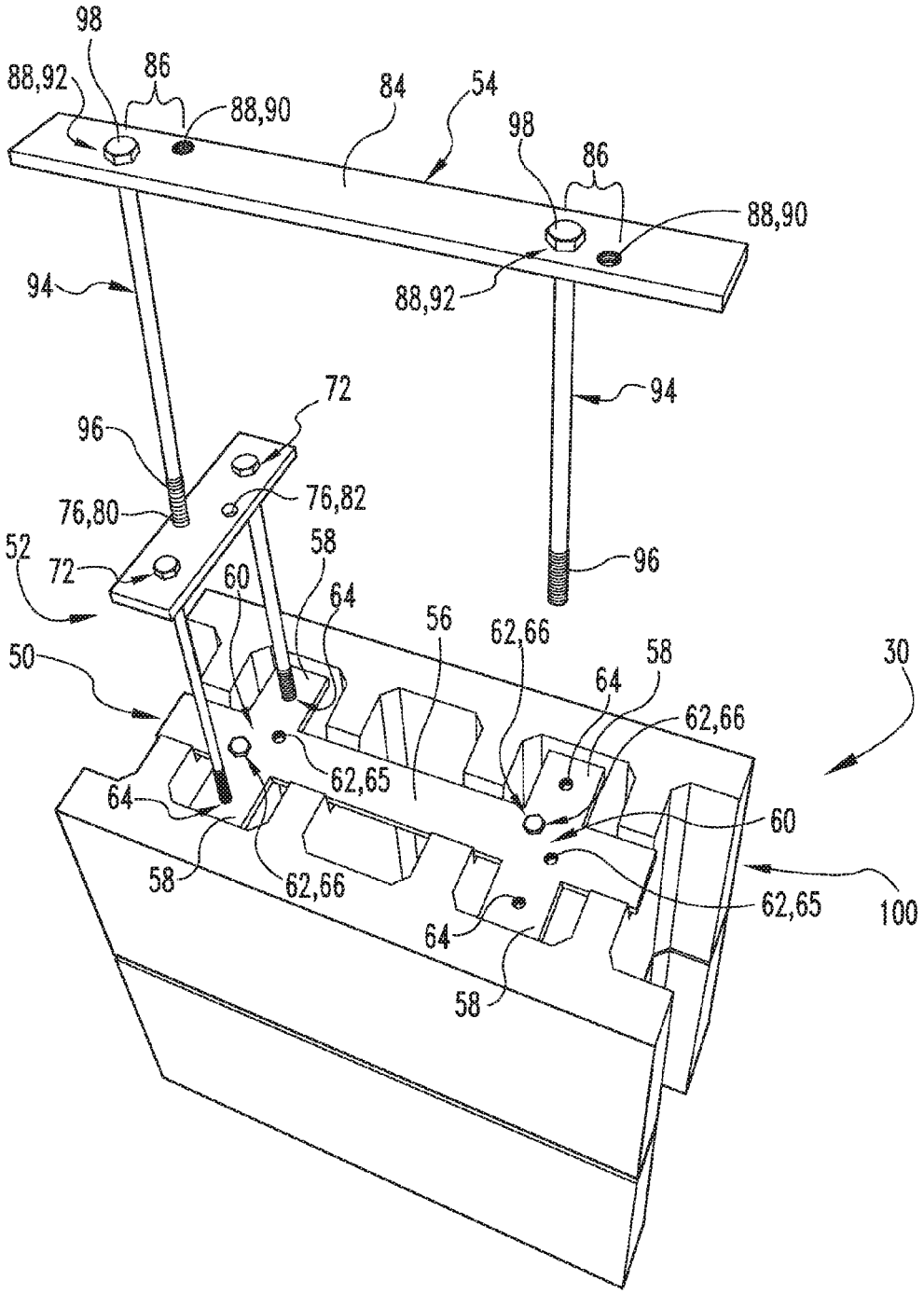
FIG. 3 is a perspective view of an anchor member, cross bar, and anchor bar, with the anchor bar shown positioned relative to a concrete masonry block, according to an embodiment of the present disclosure.

Turning now to FIG. 3, hardware for the mechanically secured building block system includes a plurality of anchor members 50, pairs of cross bars 52, and anchor bars 54. Each anchor member 50 may include a central elongated body 56 and a plurality of fingers 58 extending perpendicularly from opposing sides of the central elongated body 56. Each anchor member 50 may also include first and second sets 60 of apertures 62 extending through the central elongated body 56 and a threaded aperture 64 extending through each finger 58. The first and second sets 60 of apertures 62 may be positioned on opposing ends of the central elongated body 56, and each of the first and second sets 60 of apertures 62 may include a threaded aperture 65 and a non-threaded aperture 66.

Figure 4:
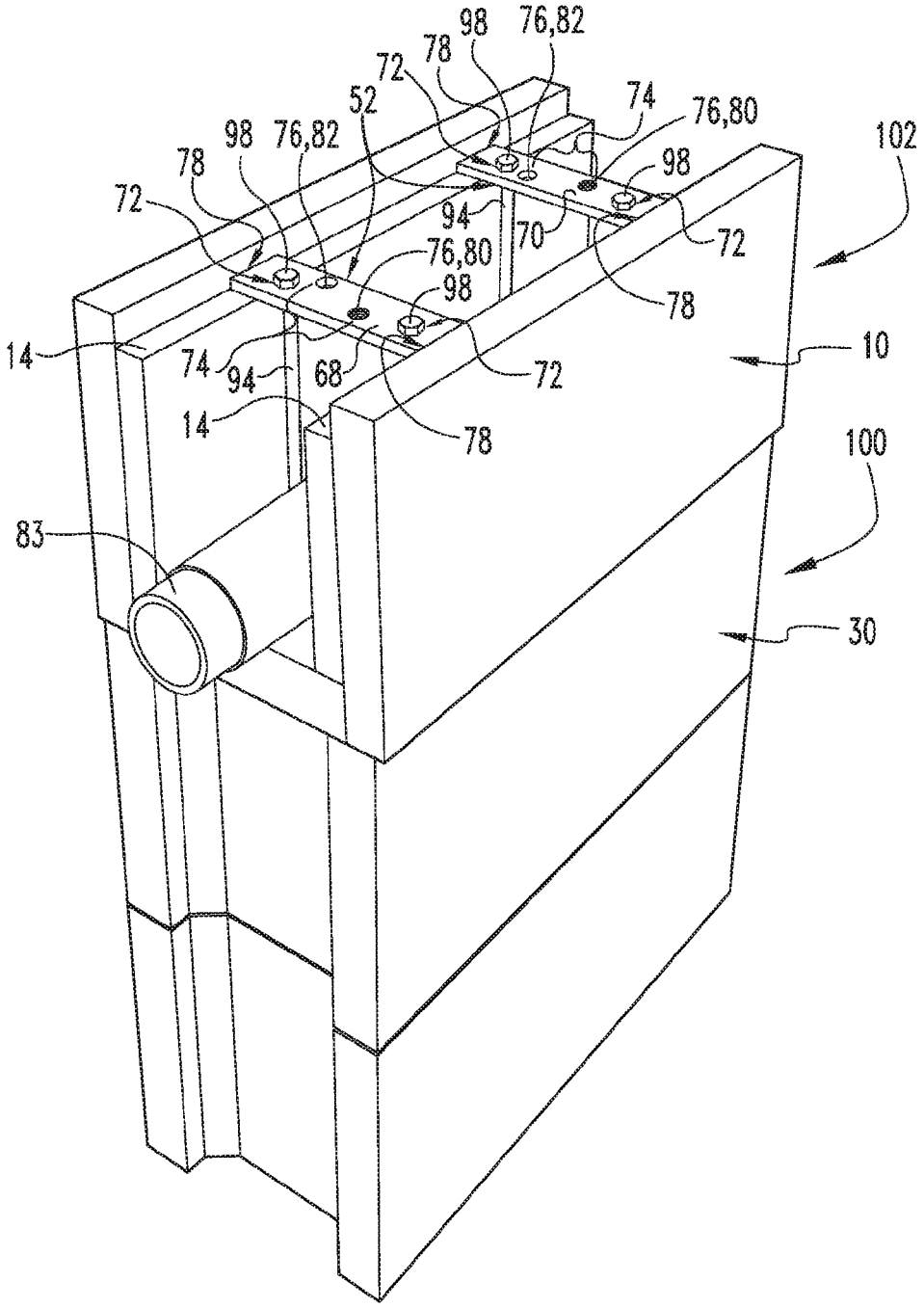
FIG. 4 is a perspective view of a set of cross bars shown positioned relative to a trough block, with a pipe positioned through the trough block.
Figure 5:
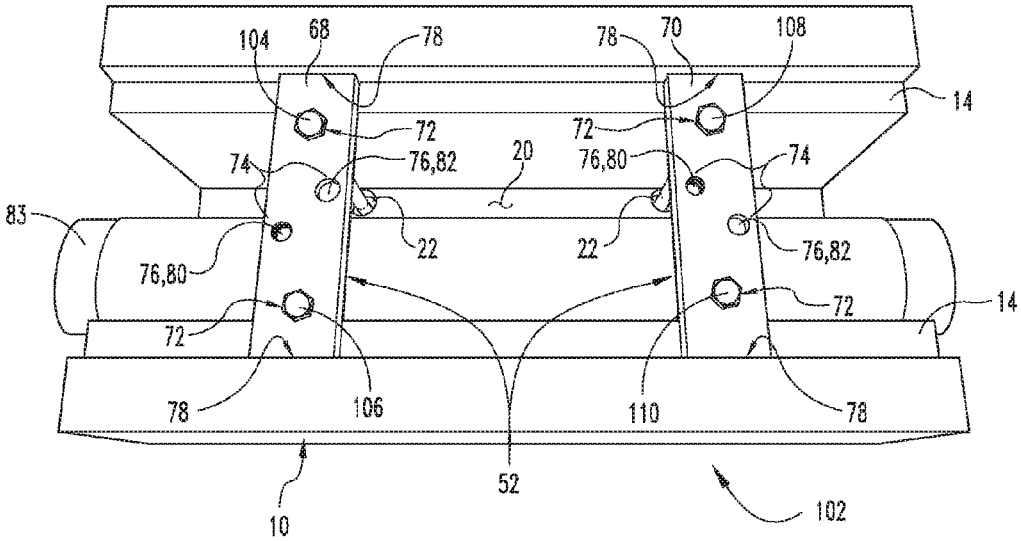
FIG. 5 is another perspective view of the trough block of FIG. 4, having the set of cross bars supported thereon and the pipe positioned therethrough.

Referring also to FIG. 4, each of the pairs of cross bars 52, or cross bar pairs, may include a first cross bar 68 and a second cross bar 70. Each of the first and second cross bars 68, 70 may include non-threaded apertures 72 through opposing ends thereof and a centrally positioned set 74 of apertures 76. The non-threaded apertures 72 on opposing ends of the first and second cross bars 68, 70 may be vertically aligned with corresponding apertures 22 through the bottom 20 of the trough block 10, as shown in FIG. 5, when outer ends 78 of the first and second cross bars 68, 70 are supported on the oppositely disposed inner ledges 14 of the trough block 10. The centrally positioned set 74 of apertures 76 of each of the first and second cross bars 68, 70 may include a threaded aperture 80 and a non-threaded aperture 82. As shown in both FIGS. 4 and 5, a pipe, or conduit, 83 may be positioned longitudinally within the interior cavity 12 of the trough block 10.

Figure 6:
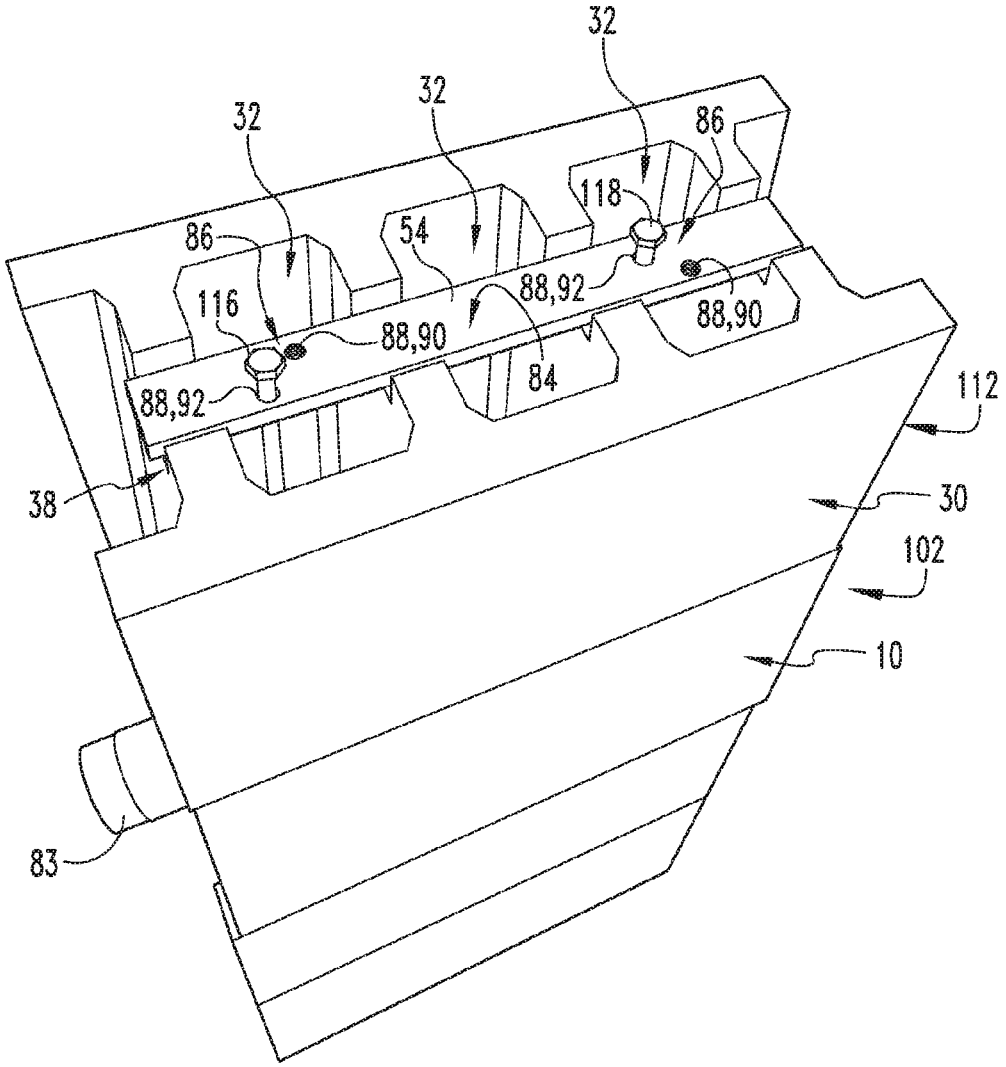
FIG. 6 is a perspective view of an anchor member shown positioned relative to a concrete masonry block.

Turning now to FIG. 6, each anchor bar 54 may include an elongated body 84 with first and second sets 86 of apertures 88 extending through the elongated body 84 at opposing ends thereof. Each of the first and second sets 86 of apertures 88 may be vertically aligned with one of the plurality of through cavities 32 of the concrete masonry units 30 when the anchor bar 54 is positioned within the anchor bar channel 38, as shown. Each of the first and second sets 86 of apertures 88 of the anchor bars 54 may include a threaded aperture 90 and a non-threaded aperture 92.

Referring back to FIG. 3, the mechanically secured block building system of the present disclosure may also include a plurality of bolts 94. Each bolt 94 has a threaded portion 96 opposite a head portion 98, with a length size to accomplish the function described herein. The bolts 94 and the various apertures described herein may be sized such that the threaded portion 96 of the bolt 94 may pass through non-threaded apertures, with passage of the head portion 98 being prevented, and the threaded portion 96 may threadably engage threaded apertures. The bolts 94 may work with each of the anchor members 50, pairs of cross bars 52, and anchor bars 54 in securing the trough blocks 10 and concrete masonry units 30 as described herein.

Also shown in FIG. 3, a first concrete masonry unit 100 has an anchor member 50 positioned such that the central elongated body 56 of the anchor member 50 is supported within the anchor bar channel 38 of the first concrete masonry unit 100. A first trough block 102 is positioned above the first concrete masonry unit 100, as shown in FIGS. 4 and 5, in a stacked configuration, and a pair of cross bars 52 has outer ends 78 of the first and second cross bars 68, 70 supported on the oppositely disposed inner ledges 14 of the first trough block 102.

First and second bolts 104, 106 are passed through the non-threaded apertures 72 of opposing ends of the first cross bar 68, corresponding apertures 22 through the bottom 20 of the first trough block 10, and are threaded into threaded apertures 64 of fingers 58 of the anchor member 50, with the various apertures described herein being positioned to accommodate such passage. Third and fourth bolts 108, 110 are passed through the non-threaded apertures 72 of opposing ends of the second cross bar 70, corresponding apertures 22 through the bottom 20 of the first trough block 10, and are threaded into threaded apertures 64 of fingers 58 of the anchor member 50.

As shown in FIG. 6, a second concrete masonry unit 112 is positioned above the first trough block 102 in a stacked configuration and an anchor bar 54 is positioned within the anchor bar channel 38 of the second concrete masonry unit 112. A first bolt 116 is passed through the non-threaded aperture 92 of the first set 86 of apertures 88 of the anchor bar 54, a through cavity 32 of the second concrete masonry unit 112, and is threaded into the threaded aperture 80 of the centrally positioned set 74 of apertures 76 of the first cross bar 68. A second bolt 118 is passed through the non-threaded aperture 92 of the second set 86 of apertures 88 of the anchor bar 54, a different through cavity 32 of the second concrete masonry unit 112, and is threaded into the threaded aperture 80 of the centrally positioned set 74 of apertures 76 of the second cross bar 70.

Figure 7:
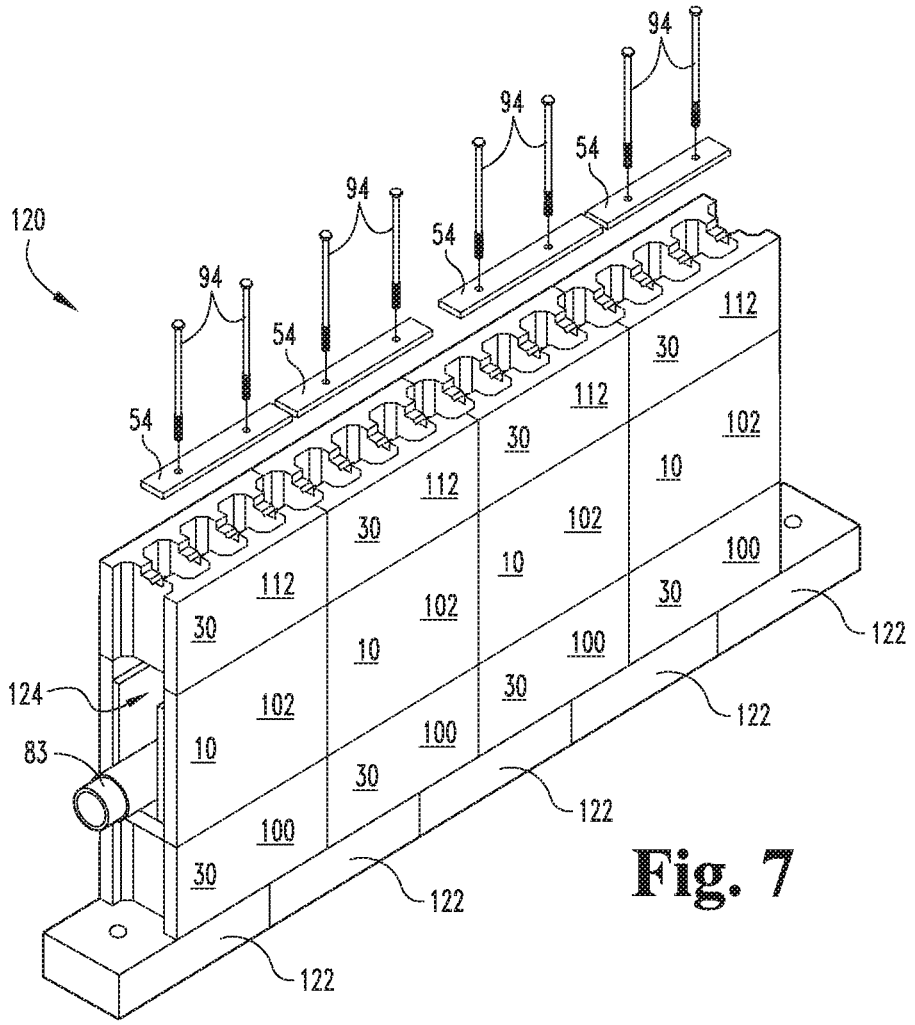
FIG. 7 is a perspective view of a mechanically secured block building system according to one embodiment of the present disclosure, shown at a stage of assembly.

Turning now to FIG. 7, an exemplary embodiment of a mechanically secured block building system 120 shown at a stage of assembly. As should be appreciated, the mechanically secured block building system 120 may be assembled in unique and various ways to construct multiple width walls, grade beams, horizontal decks, and the like, including both running and stacked bond patterns. The trough blocks 10 and concrete masonry units 30 may be incorporated into various existing unitized post tension components or systems. According to some embodiments, the first concrete masonry units 100 may be supported on footers 122, as shown, or on additional anchor bars 54, or using some other known means. In an assembled configuration of the trough blocks 10, as shown, the trough blocks 10 are mechanically secured in an end-to-end arrangement and the interior cavities 12 align to define a continuous pipe channel 124 therethrough.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A mechanically secured block building system for constructing structures, the system including:

a plurality of concrete masonry units with each concrete masonry unit defining a length and a width and including a plurality of through cavities extending from a top surface of the concrete masonry unit to a bottom surface of the concrete masonry unit, and an anchor bar channel formed in the top surface along the length of the concrete masonry unit;

a plurality of anchor bars with each anchor bar including an elongated body with first and second sets of apertures extending through the elongated body at opposing ends thereof, wherein each of the first and second sets of apertures are vertically aligned with one of the plurality of through cavities of the concrete masonry units when the anchor bar is positioned within the anchor bar channel;

a plurality of trough blocks with each trough block having dimensions corresponding to each concrete masonry unit, each trough block having an interior cavity characterized by a U-shaped cross section, each trough block having a pair of oppositely disposed inner ledges recessed relative to top surfaces of opposing outer walls, wherein a bottom of the trough blocks includes a plurality of apertures therethrough;

a plurality of cross bar pairs, each cross bar pair including first and second cross bars, each of the first and second cross bars including non-threaded apertures through opposing ends thereof and a centrally positioned set of apertures, wherein the non-threaded apertures on opposing ends of the first and second cross bars are vertically aligned with the apertures through the bottom of the trough block when outer ends of the first and second cross bars are supported on the oppositely disposed inner ledges of the trough block;

a plurality of bolts, each bolt having a threaded portion opposite a head portion;

wherein, in an assembled configuration of the trough blocks, the trough blocks are mechanically secured in an end-to-end arrangement and the interior cavities align to define a continuous pipe channel therethrough;

wherein the anchor bar channel is centered relative to the width of each concrete masonry unit;

wherein each of the first and second sets of apertures of the anchor bars and the centrally positioned set of apertures of the first and second cross bars each include a threaded aperture and a non-threaded aperture; and wherein, according to the assembled configuration:

a first trough block has a first cross bar pair with outer ends of first and second cross bars of the first cross bar pair supported on the oppositely disposed inner ledges of the first trough block;

a first concrete masonry unit is positioned above the first trough block in a stacked configuration and a first anchor bar is positioned within the anchor bar channel of the first concrete masonry unit;

a first bolt is passed through the non-threaded aperture of the first set of apertures of the first anchor bar, a first through passage of the first concrete masonry unit, and is threaded into the threaded aperture of the centrally positioned set of apertures of the first cross bar; and a second bolt is passed through the non-threaded aperture of the second set of apertures of the first anchor bar, a second through passage of the first concrete masonry unit, and is threaded into the threaded aperture of the centrally positioned set of apertures of the second cross bar.

2. A mechanically secured block building system for constructing structures, the system including:

a plurality of concrete masonry units with each concrete masonry unit defining a length and a width and including a plurality of through cavities extending from a top surface of the concrete masonry unit to a bottom surface of the concrete masonry unit, and an anchor bar channel formed in the top surface along the length of the concrete masonry unit;

a plurality of anchor bars with each anchor bar including an elongated body with first and second sets of apertures extending through the elongated body at opposing ends thereof, wherein each of the first and second sets of apertures are vertically aligned with one of the plurality of through cavities of the concrete masonry units when the anchor bar is positioned within the anchor bar channel;

a plurality of trough blocks with each trough block having dimensions corresponding to each concrete masonry unit, each trough block having an interior cavity characterized by a U-shaped cross section, each trough block having a pair of oppositely disposed inner ledges recessed relative to top surfaces of opposing outer walls, wherein a bottom of the trough blocks includes a plurality of apertures therethrough;

a plurality of cross bar pairs, each cross bar pair including first and second cross bars, each of the first and second cross bars including non-threaded apertures through opposing ends thereof and a centrally positioned set of apertures, wherein the non-threaded apertures on opposing ends of the first and second cross bars are vertically aligned with the apertures through the bottom of the trough block when outer ends of the first and second cross bars are supported on the oppositely disposed inner ledges of the trough block; and a plurality of anchor members with each anchor member including a central elongated body and a plurality of fingers extending perpendicularly from opposing sides of the central elongated body, each anchor member including first and second sets of apertures extending through the central elongated body and each finger including a threaded aperture therethrough, wherein each of the first and second sets of apertures are vertically aligned with one of the plurality of through cavities of the concrete masonry units when the central elongated body of the anchor member is positioned within the anchor bar channel;

wherein, in an assembled configuration of the trough blocks, the trough blocks are mechanically secured in an end-to-end arrangement and the interior cavities align to define a continuous pipe channel therethrough.

3. The system of claim 2, wherein the first and second sets of apertures are positioned on opposing ends of the central elongated body.

4. The system of claim 3, wherein each of the first and second sets of apertures includes a threaded aperture and a non-threaded aperture.

5. The system of claim 4, wherein, according to the assembled configuration:

a first concrete masonry unit has a first anchor member positioned such that the central elongated body of the anchor member is supported within the anchor bar channel of the first concrete masonry unit;

a first trough block is positioned above the first concrete masonry unit in a stacked configuration and a first cross bar pair has outer ends of the first and second cross bars supported on the oppositely disposed inner ledges of the first trough block;

first and second bolts are passed through the non-threaded apertures of opposing ends of the first cross bar, apertures through the bottom of the first trough block, and are threaded into threaded apertures of fingers of the first anchor member; and third and fourth bolts are passed through the non-threaded apertures of opposing ends of the second cross bar, apertures through the bottom of the first trough block, and are threaded into threaded apertures of fingers of the first anchor member.

* * * * *